United States Patent [19]

Hale

[11] Patent Number: 5,044,502

[45] Date of Patent: Sep. 3, 1991

[54] NESTABLE FIBER DRUM WITH INTEGRAL SKID AND A METHOD OF MAKING THE SAME

[75] Inventor: James A. Hale, Red Bank, N.J.

[73] Assignee: 501 Greif Bros., Del.

[21] Appl. No.: 487,189

[22] Filed: Mar. 1, 1990

[51] Int. Cl.[5] ..... B65D 19/00

[52] U.S. Cl. ..... 206/595; 206/508; 206/509; 220/1.5; 220/633; 220/660; 229/5.7

[58] Field of Search ..... 206/508, 509, 595; 220/1.5, 633, 634, 610, 612, 660; 229/5.5, 5.6, 5.7

[56] References Cited

U.S. PATENT DOCUMENTS

| | | | |
|---|---|---|---|
| 935,029 | 9/1909 | Jenkins . | |
| 1,485,408 | 3/1924 | Miller | 220/634 |
| 1,511,915 | 10/1924 | Sherk . | |
| 2,269,785 | 1/1942 | Rigerman | 229/5.7 |
| 2,353,678 | 7/1944 | Lockwood . | |
| 2,369,012 | 2/1945 | Braloff | 229/5.7 |
| 2,391,212 | 12/1945 | Williams | 229/5.7 |
| 2,457,198 | 12/1948 | Bell . | |
| 2,644,219 | 12/1953 | Schmidt | 220/633 |
| 3,273,739 | 9/1966 | Wei . | |
| 3,942,670 | 3/1976 | Mingus | 206/595 |
| 4,135,657 | 12/1979 | Benson | 229/5.7 |
| 4,377,231 | 3/1983 | Murphy . | |
| 4,415,077 | 11/1983 | Murphy . | |
| 4,444,324 | 4/1984 | Grenell . | |
| 4,485,924 | 12/1984 | Ripoll | 220/1.5 |
| 4,660,724 | 4/1987 | Gaynes | 220/1.5 |

FOREIGN PATENT DOCUMENTS

| | | | |
|---|---|---|---|
| 640385 | 4/1962 | Canada | 229/5.7 |

*Primary Examiner*—Stephen Marcus
*Assistant Examiner*—Stephen Cronin
*Attorney, Agent, or Firm*—Kane Dalsimer Sullivan Kurucz Levy Eisele and Richard

[57] ABSTRACT

A fiber drum with an integral skid is made by providing a lower skirt on a drum body. The skirt has cutouts for engagement by mechanized drum handling apparatus. The drum may also include an upper skirt cooperating with the lower skirt to maintain several drums aligned vertically for stacking.

18 Claims, 5 Drawing Sheets

NESTABLE FIBER DRUM WITH INTEGRAL SKID AND A METHOD OF MAKING THE SAME

BACKGROUND OF THE INVENTION a. Field of Invention

This invention pertains to a fiber drum, and more particularly, a drum with an integral skid to allow the drum to be handled by mechanized means. The drum also has features which allow several drums to be stacked safely.

b. Description of the Prior Art

Fiber drums are frequently used for shipping and storing various goods. They are preferred in certain fields over other types of drums, such as metallic drums because they are lightweight, yet strong. Frequently, to save storage space, it is desirable to stack several drums on top of each other. However, the fiber drums produced until now had flat tops and bottoms and could not be stacked safely.

Another consideration for drums is that a filled drum can be quite heavy and must be handled by using mechanized means, such as fork lifts. However, fiber drums made until now could not be handled easily with fork lifts. Therefore, frequently fiber drums are mounted on external skids. However, these skids are expensive, and furthermore securing a drum to a skid is time consuming and may compromise the integrity of the drum.

OBJECTIVES AND SUMMARY OF THE INVENTION

In view of the above mentioned disadvantages of fiber drums, it is an objective of the present invention to provide a fiber drum with nesting means whereby several drums can be stacked on top of each other.

A further objective is to provide a drum with a built in skid so that it can be maneuvered easily using mechanized means.

Yet a further objective is to provide an improved fiber drum which remains lightweight, strong, and is easy and efficient to make.

Other objectives and advantages of the invention shall become apparent from the following description of the invention. Briefly, a fiber drum constructed in accordance with this invention comprises a drum body with a continuous sidewall means and a bottom, and a cover for covering the drum body. A lower skirt member is secured to the bottom, for example, by a band which partially overlaps both the drum body and the lower skirt member. The lower skirt member is made with cutouts for engagement by a mechanized drum handling means such as a hydraulic lift. The cover may also be provided with an upper skirt. The upper and lower skirts are dimensioned so that they partially fit or telescope into each other to permit vertical stacking of the drums.

DETAILED DESCRIPTION OF THE INVENTION

Figure 1:
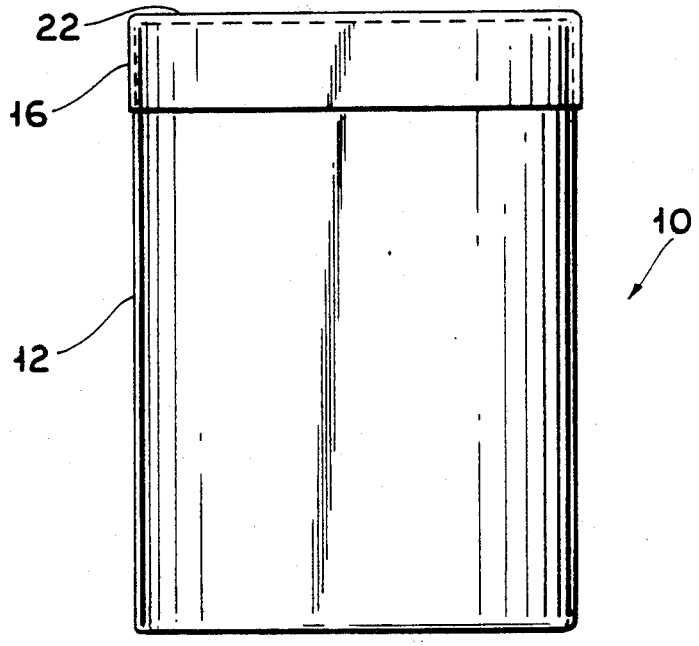
FIG. 1 shows side view of a body and cover for a fiber drum constructed in accordance with this invention.

Referring now to the drawings, a fiber drum 10 constructed in accordance with this invention consists of a tubular body 12 with a continuous body sidewall 14, and a cover 16 with a continuous cover sidewall 18. The cover 16 fits over the body with the cover sidewall 18 overlapping and fitting tightly over the body sidewall 14 to form an interference fit therewith. Thus, the body and the cover cooperate to form a container for shipping and storing various dry, semi-liquid or liquid goods. If necessary, the drum may be sealed with a sealing tape (not shown) applied partially or fully on the interface between the cover and the body as shown in FIG. 1. As show in FIG. 2, an upper skirt 20 is formed on the cover by taking, for example, a strip of material and securing it with an adhesive to an upper section of cover sidewall 18. The skirt 20 is disposed so that it extends above the top surface 22 to form a disk shaped cavity 24 therewith. Preferably skirt 20 is formed from the same material as the body 12 and cover 16.

Figure 2:
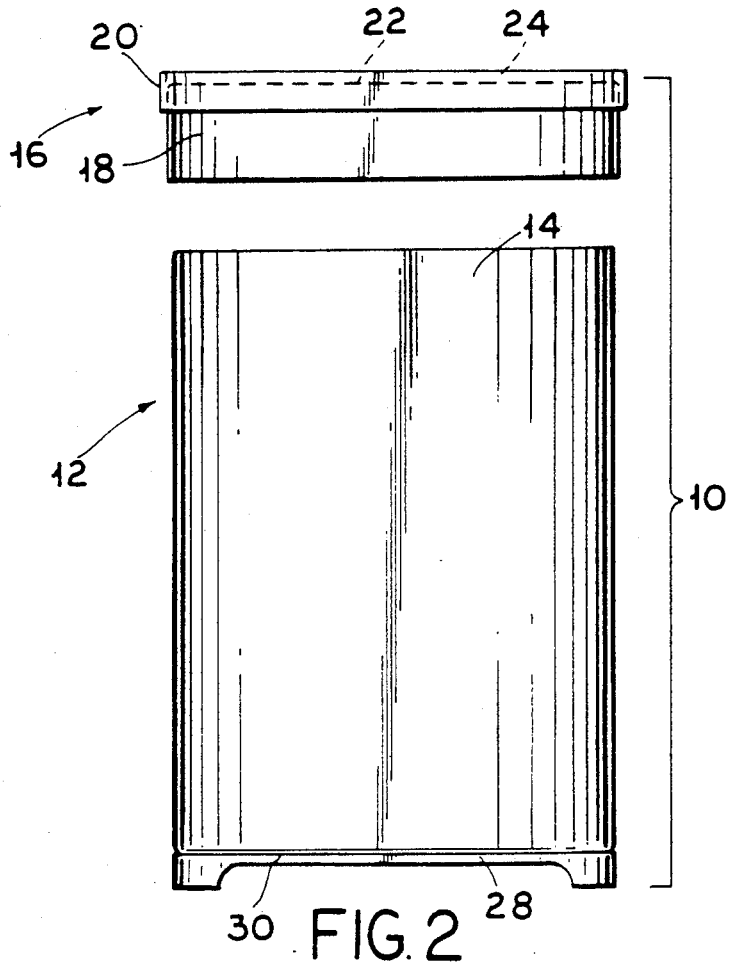
FIG. 2 shows in side view the members of FIG. 1 with a top skirt and a skid member added.
Figure 3:
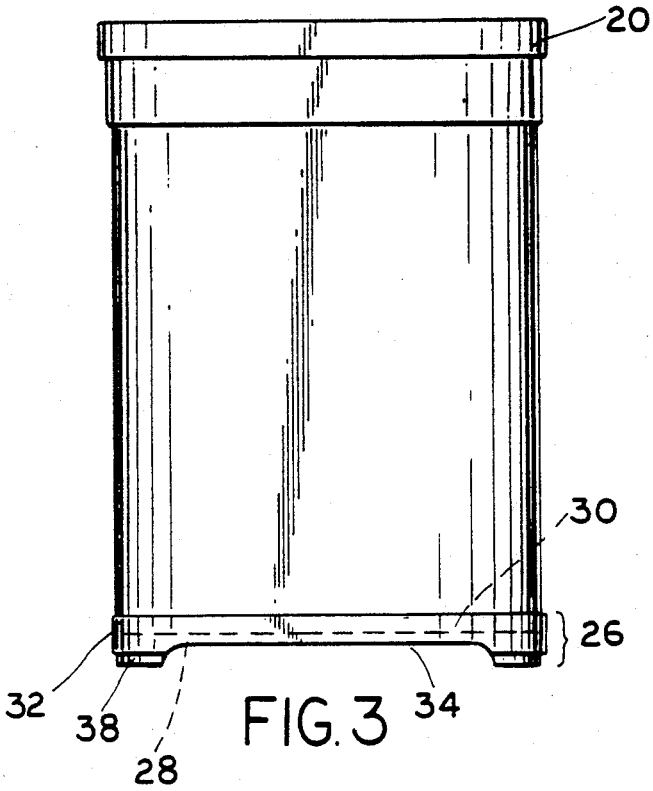
FIG. 3 shows a side view of an assembled fiber drum constructed in accordance with this invention.
Figure 4:
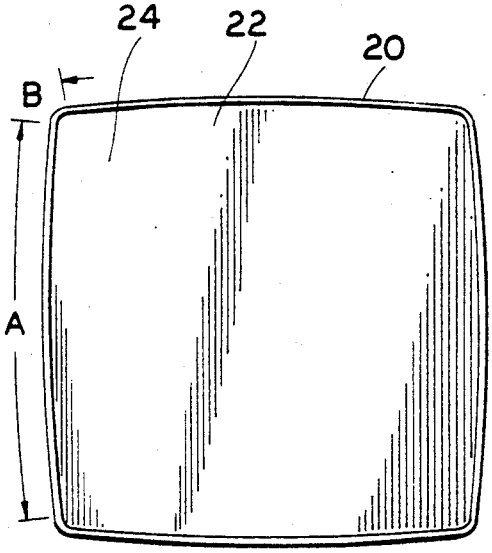
FIG. 4 shows a top view of a first embodiment of the invention.
Figure 5:
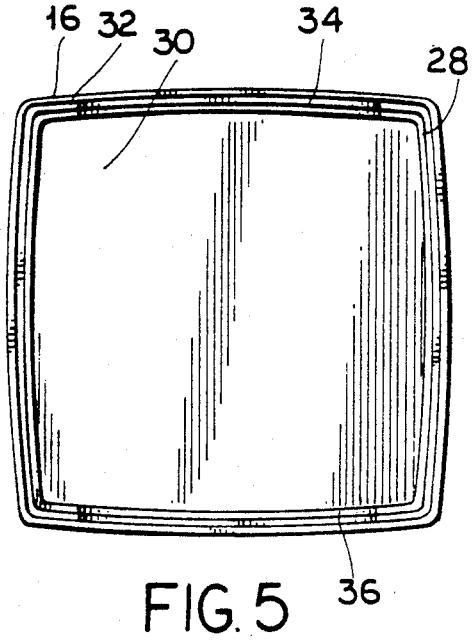
FIG. 5 shows a bottom view of the first embodiment of the invention.

The drum is also provided with a lower skirt 26 as follows. First a first bottom skirt member 28 is formed having an outer perimeter of the exact shape and size as the body sidewall 14. This member 28 is then placed adjacent to the bottom surface 30 of body 12 with the skirt member 28 forming an extension for the sidewall 14 as shown in FIG. 2. A band 32 is then positioned to overlap both the skirt member 28 and a lower portion of body 12 to secure the skirt member 28 to body 12. Although band 32 may be made to form an interference fit with both the skirt member 28 and the lower portion of the body 12, preferably, band 32 is secured adhesively to these elements. Thus, lower skirt 26 is formed of skirt member 28 and band 32. Lastly on two opposite sides of the lower skirt, two corresponding cutouts 34, 36 are made. These cutouts are sized and shaped to permit the drum to be lifted and manipulated by mechanized means such as a hydraulic lift. Preferably the skirt member 28 has a section which extends below the band 32 to form a section 38 therebetween. The purpose of this shoulder is explained below. Thus, the lower skirt provides in effect a built in skid, thereby eliminating the need for external and more expensive external skids. In addition, the upper and lower skirts 20, 26 reinforce the drum and furthermore cooperate to allow several drums to be stacked vertically as described more fully below. In the embodiment shown in FIGS. 4–6, the sidewall of the drum 10 is continuous, consisting of four substantially equal sections having a very large radius of curvature around the vertical axis of the drum, such as section A in FIG. 4. These sections are joined by four sections, such as section B, having a much smaller radius of curvature. The resulting structure is similar to a container having a square cross-section, and shares its advantages in that it utilizes space more efficiently. However, such a container is easier to make than a square container, it is stronger, and it lacks sharp corners which are easily damaged.

Figure 6:
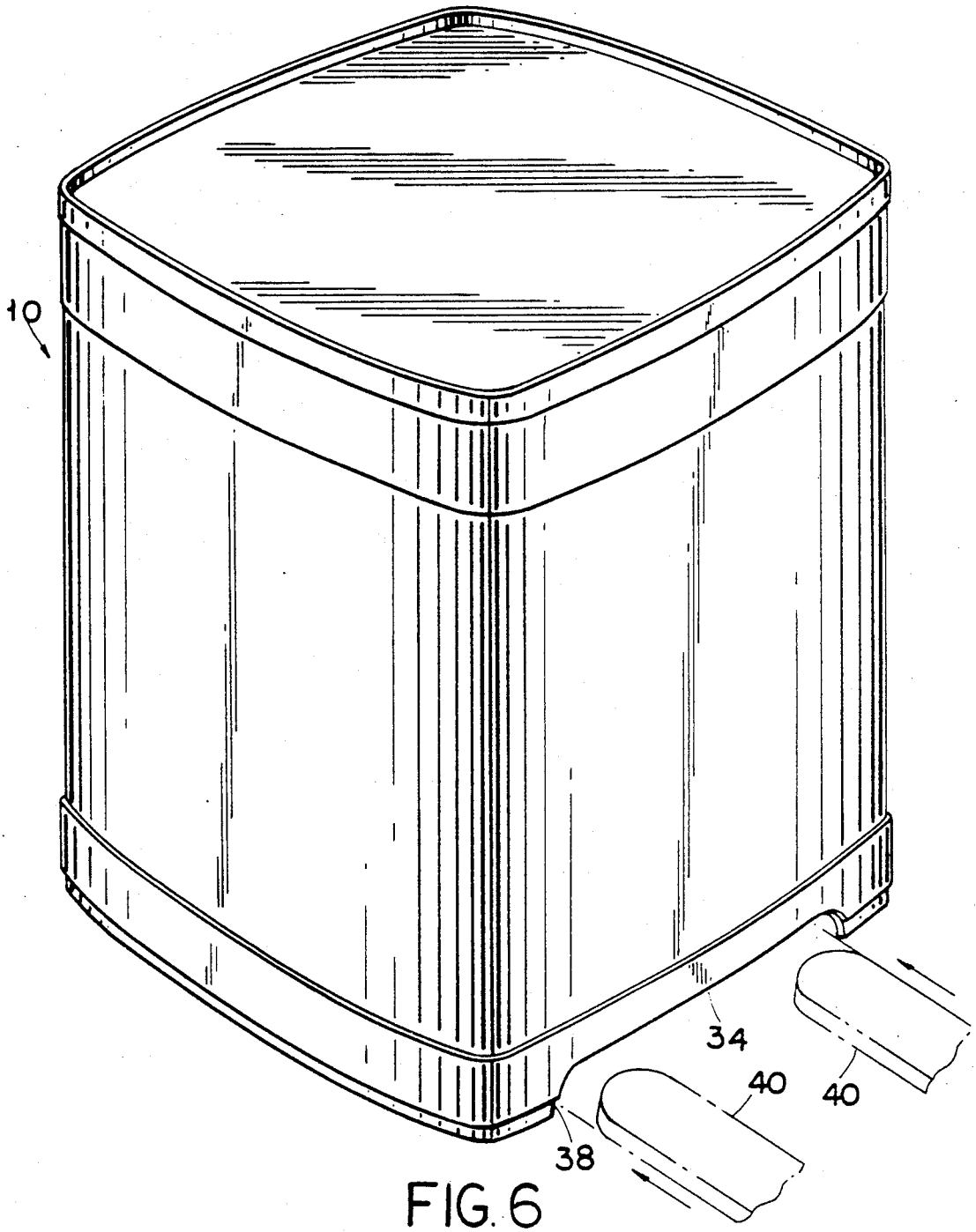
FIG. 6 shows an orthogonal view of the drum of FIGS. 3–5.

FIG. 6 further shows a drum 10 with its cutouts 34 being engaged by the tines 40 of a hydraulic lift.

Figure 7:
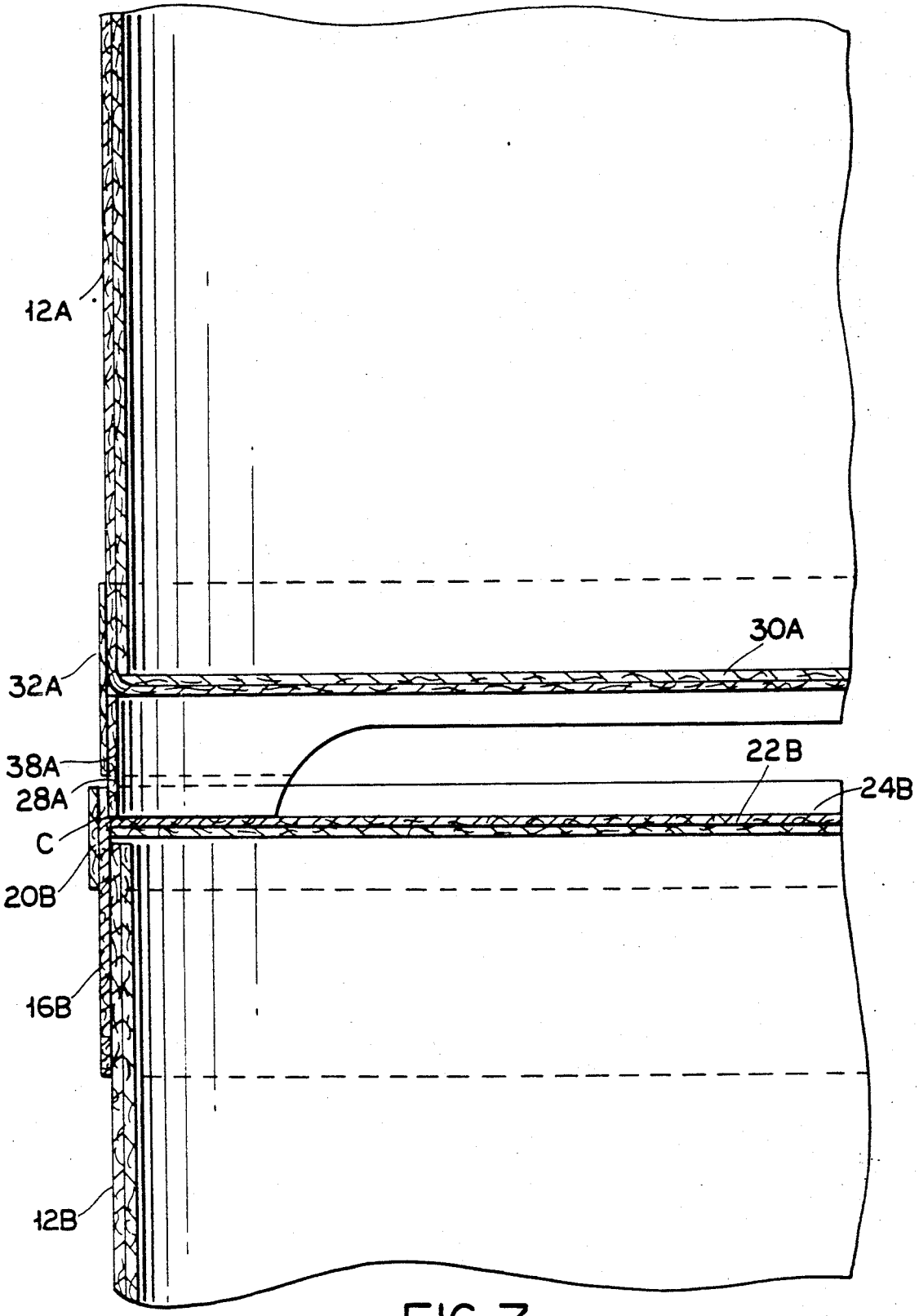
FIG. 7 shows a partial side-sectional view of two fiber drums constructed in accordance with this invention and stacked on top of each other.

FIG. 7 shows two drums constructed in accordance with the above description and FIGS. 1-6. The elements of the top drum are identified by the letter A and the elements of the bottom drum are identified by the letter B for the sake of clarity. As can be seen from these Figures, the skirts of the drums are sized and shaped so that the drums can be stacked easily and securely on top of each other. More particularly, the tubular section of the skirt member 28A extending below shoulder 38A fits into the cavity 24B. Because this member 28A has the same diameter as the bodies 12A, 12B, while skirt 20A has a slightly larger diameter due to the fact that cover 16A is slightly larger, there is a small clearance C radially between the two drums to insure that there is no interlock therebetween. If member 28A and skirt 20B would have identical nominal dimensions, then the two drums may interlock. Furthermore, the drums can be made with larger tolerances. There is sufficient lateral support provided by the skirts so that several drums can be stacked vertically on top of each other. The skirts are further useful in aligning the vertically stacked drums. As shown in FIG. 7, the drums 10A, 10B may be made from one or more layers of fiber.

Figure 8:
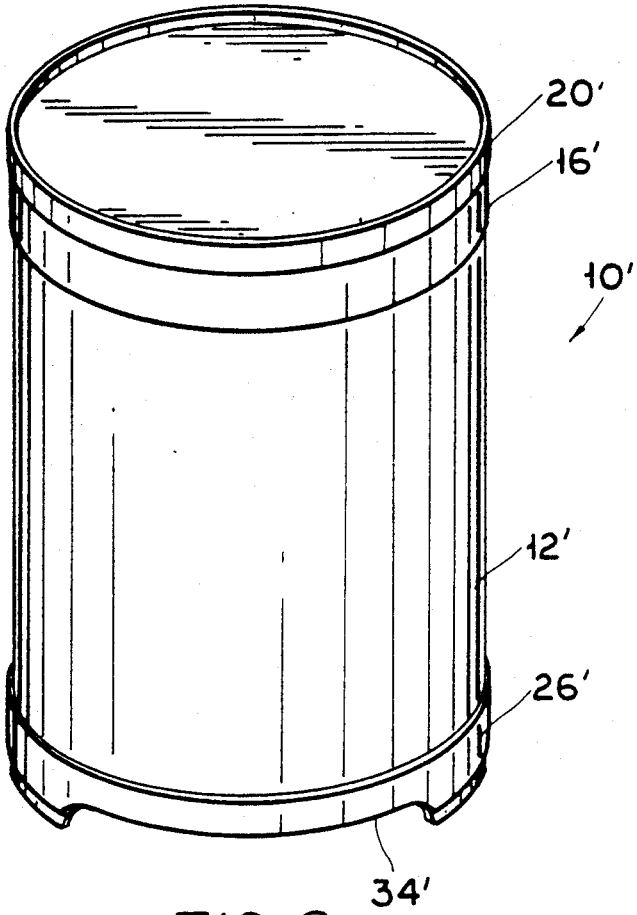
FIG. 8 shows an orthogonal view of a second embodiment of the invention.
Figure 9:
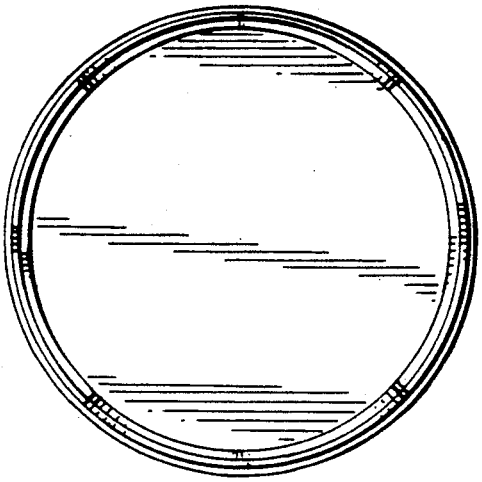
FIG. 9 shows a bottom view of the second embodiment.

In FIGS. 8 and 9 an alternate embodiment of the invention is shown in which the drum 10' is cylindrical. Drum 10' also includes a body 12' with a lower skirt 26' having cutouts (such as 34') for handling by a hydraulic lift. Drum 10' further has an upper skirt 20'. Drum 10' may be used in a manner identical to the drum shown in FIGS. 1-7.

Obviously numerous modifications may be made to the present invention without departing from its scope as defined in the appended claims.

I claim:

1. A fiber drum with an integral skid comprising:

a. a drum body having a sidewall with a lower sidewall portion and a bottom secured to said sidewall; and b. a lower skirt with downwardly extending cutouts arranged and constructed for engagement by mechanized handling means, said lower skirt including a lower skirt member having an outer skirt member dimension, and a lower band partially overlapping said lower sidewall portion and said lower skirt member for securing said skirt to said drum body, said lower skirt member having a tubular section extending below said lower band.

2. The fiber drum of claim 1 further comprising a cover fitted over said drum body, said cover defining an upper cavity with a cavity inner dimension selected for nesting the lower skirt section of one drum in the upper cavity of another drum when several drums are stacked.

3. The fiber drum of claim 2 wherein said cavity inner dimension is larger than said outer skirt member dimension.

4. The fiber drum of clam 2 wherein said cover includes a cover body extending downwardly to fit telescopically over said drum body, and an upper skirt secured to said cover body to define said upper cavity.

5. The drum of claim 1 wherein said sidewall consists of several sidewall sections having a relatively large radius of curvature joined by corner sections having a smaller radius of curvature.

6. The drum of claim 1 wherein said sidewall has a substantially cylindrical cross-section.

7. A stackable fiber drum comprising:

a. a drum body having continuous body sidewall with a lower body portion and a bottom secured to said sidewall;

b. cover means for covering said drum body; and c. a lower skirt having a lower skirt member with a perimeter substantially identical to the perimeter of said body sidewall, and circumferential lower band means overlapping said lower body portion and said lower skirt member for securing said lower skirt member to said drum body, said lower skirt having a section extending below said lower band.

8. The drum of claim 7 wherein said lower band means is adhesively secured to said sidewall and said lower skirt member.

9. The drum of claim 7 wherein said lower skirt member is provided with cutout means for engagement by a mechanized drum handler.

10. The drum of claim 7 wherein said cover includes a cover sidewall, and a top.

11. The drum of claim 10 wherein said cover further includes an upper skirt secured to said cover sidewall and extending above said top.

12. The drum of claim 11 wherein said upper skirt includes an upper band adhesively secured to said cover sidewall.

13. The drum of claim 12 wherein said upper skirt defines a cavity open upwards and having a cavity perimeter selected for nesting said lower skirt.

14. The drum of claim 13 wherein said drum body has a drum body outer dimension, said lower skirt section has a lower skirt section outer dimension substantially equal to said drum body dimension and wherein said cavity has a cavity inner dimension slightly larger than said lower skirt section outer dimension.

15. A method of making a fiber drum with an integral skid consisting of steps of:

a. providing a drum body having a sidewall and a bottom secured to said sidewall;

b. providing a cover for covering said drum body;

c. placing a lower skirt member having the same outer dimensions as said drum body adjacent to said bottom; and d. securing said lower skirt member to said body by partially overlapping said lower skirt member and said drum body, with a lower circumferential band, said lower band leaving a lower section of said lower skirt member uncovered.

16. The method of claim 15 further comprising the step of making cutouts in said lower skirt member for engagement by a mechanized drum handling means.

17. The method of claim 15 further comprising the step of securing an upper skirt to said cover, said upper and lower skirt cooperating for vertical stacking.

18. The method of claim 15 comprising the step of applying an upper circumferential band to said cover to form said upper skirt and to define a cavity with an inner dimension larger than the outer dimension of said drum body.

* * * * *